United States Patent [19]

Pinkerton

[11] Patent Number: 5,020,980

[45] Date of Patent: Jun. 4, 1991

[54] VALVELESS, POSITIVE DISPLACEMENT PUMP INCLUDING HINGE FOR ANGULAR ADJUSTMENT

[76] Inventor: Dennis Pinkerton, 260 Sherbrook Rd., Lindenhurst, N.Y. 11757

[21] Appl. No.: 461,377

[22] Filed: Jan. 5, 1990

[51] Int. Cl.[5] ..... F04B 7/06

[52] U.S. Cl. ..... 417/500; 417/492; 417/426

[58] Field of Search ..... 417/500, 492, 415, 426; 92/13, 13.3

[56] References Cited

U.S. PATENT DOCUMENTS

| | | | |
|---|---|---|---|
| 3,168,872 | 2/1965 | Pinkerton | 417/500 |
| 3,965,758 | 6/1976 | Hope et al. | 92/13.3 |
| 4,008,003 | 2/1977 | Pinkerton . | |
| 4,941,809 | 7/1990 | Pinkerton | 417/500 |

*Primary Examiner*—Michael Koczo
*Assistant Examiner*—M. Kocharov
*Attorney, Agent, or Firm*—Hoffmann & Baron

[57] ABSTRACT

A valveless, positive displacement pump including a living hinge for angularly adjusting a pumping head with respect to a rotatable drive member is provided. The pump includes a block to which a pumping head and drive member are mounted. The block includes a first support pivotably connected to a second support by means of an integral, flexible hinge. The pumping head is mounted to the first support while the rotatable drive member is mounted to the second support. Movement of the first support about the flexible hinge allows the stroke of the piston, and therefore the flow rate of the pump, to be adjusted. Such a pump may be manufactured by extruding the block in elongate form and then cutting it into individual sections to which pumping heads may be mounted.

17 Claims, 6 Drawing Sheets

VALVELESS, POSITIVE DISPLACEMENT PUMP INCLUDING HINGE FOR ANGULAR ADJUSTMENT

BACKGROUND OF THE INVENTION

1. Field of the Invention

The field of the invention relates to metering pumps for pumping relatively precise volumes of fluid.

2. Brief Description of the Prior Art

Valveless, positive displacement metering pumps have been successfully employed in many applications where safe and accurate handling of fluids is required. The valveless pumping function is accomplished by the synchronous rotation and reciprocation of a piston in a precisely mated cylinder bore. One pressure and one suction stroke are completed per cycle. A duct (flat portion) on the piston connects a pair of cylinder ports alternately with the pumping chamber, i.e. one port on the pressure portion of the pumping cycle and the other on the suction cycle. The mechanically precise, free of random closure variation valving is performed by the piston duct motion. A pump head module containing the piston and cylinder is mounted in a manner that permits it to be swiveled angularly with respect to the rotating drive member. The degree of angle controls stroke length and in turn flow rate. The direction of the angle controls flow direction. This type of pump has been found to perform accurate transfers of both gaseous and liquid fluids.

The manner in which the pump head module is swiveled with respect to the drive member varies among the different available metering pumps. In one commercially available pump, the pump head module is secured to a plate which is, in turn, mounted to the base of the pump. The plate is pivotable about one of two pivot axes depending upon the angular orientation of the module. The base may be provided with graduations to indicate the percentage of the maximum flow rate achieved at the particular angle at which the module is directed. The maximum flow rate is achieved when the module is at its maximum angle with respect to the axis of the rotating drive member.

A valveless positive displacement pump including a working chamber which is angularly displaceable with respect to the axis of a drive shaft is disclosed in U.S. Pat. No. 4,008,003.

SUMMARY OF THE INVENTION

It is an object of the invention to provide a valveless, positive displacement metering pump including means for adjusting the flow rate thereof.

It is another object of the invention to provide a valveless, positive displacement metering pump which is easily manufactured.

A still further object of the invention is to provide a method for manufacturing a valveless, positive displacement pump in an efficient and economical manner.

In accordance with these and other objects of the invention, a valveless, positive displacement metering pump is provided which includes a housing; a working chamber within the housing; at least two ports communicating with the working chamber; a first support; means for mounting the housing to the first support; a second support; flexible hinge means connecting the first and second supports such that the first support is pivotable with respect to the second support about the flexible hinge means, the first and second supports and the flexible hinge means being of integral construction. A piston is positioned within the working chamber, the piston including a duct therein. A rotatable member is secured to the second support. Means are provided for rotating the rotatable member. Connecting means are provided for connecting the piston to the rotatable member such that the piston rotates and reciprocates within the working chamber upon rotation of the rotatable member. The stroke of the piston is dependent upon the angular position of the first support with respect to the second support.

The pump may include more than one pumping assembly pivotably mounted to the second support. Each assembly may be independently pivotable with respect to the second support.

A method for manufacturing valveless, positive displacement pumps is also provided by the invention. Such a method includes the steps of providing an integral mass of at least partially flexible material, said mass including a base portion, a top portion, and a hinge connecting said base portion and said top portion; cutting said mass through said top portion and at least part of said hinge such that said top portion is separated into at least two elements, each of said elements being independently pivotable about said hinge with respect to said base; securing a pump assembly to each of said elements, each of said pump assemblies including a working chamber, at least two ports communicating with said working chamber, and a piston within said working chamber, said piston including a duct; securing a plurality of rotatable members to said base, and connecting each of said pistons with one of said respective rotatable members such that said pistons rotate and reciprocate within said respective working chambers upon rotation of said rotatable member, the stroke of each of said pistons being dependent upon the angular orientation of said respective elements with respect to said base.

DETAILED DESCRIPTION OF THE INVENTION

A valveless, positive displacement metering pump 10 is provided which includes at least two ports, one of which is used at any one time either as inlet or outlet port while the other is used in an opposite manner. Additional ports may also be employed as discussed herein.

Figure 2:
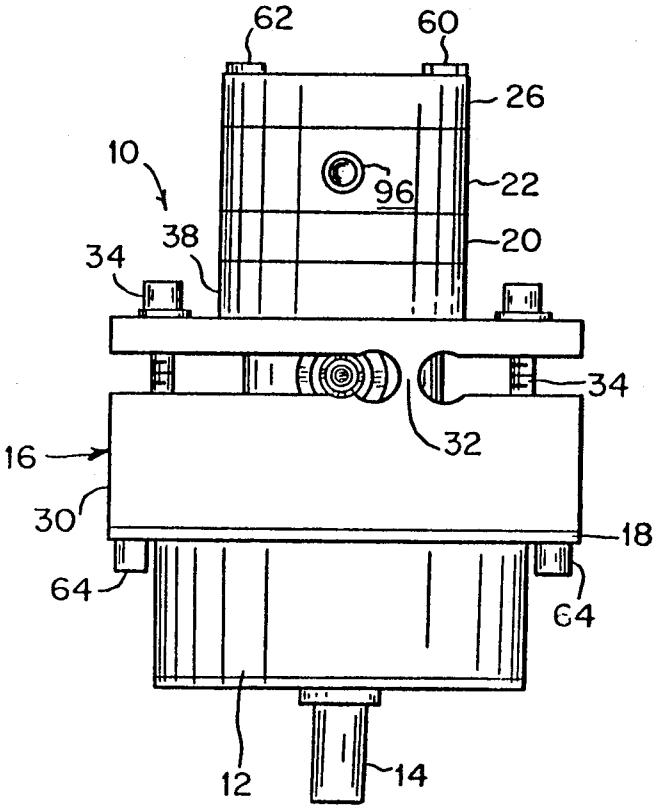
FIG. 2 is a top plan view thereof.
Figure 1:
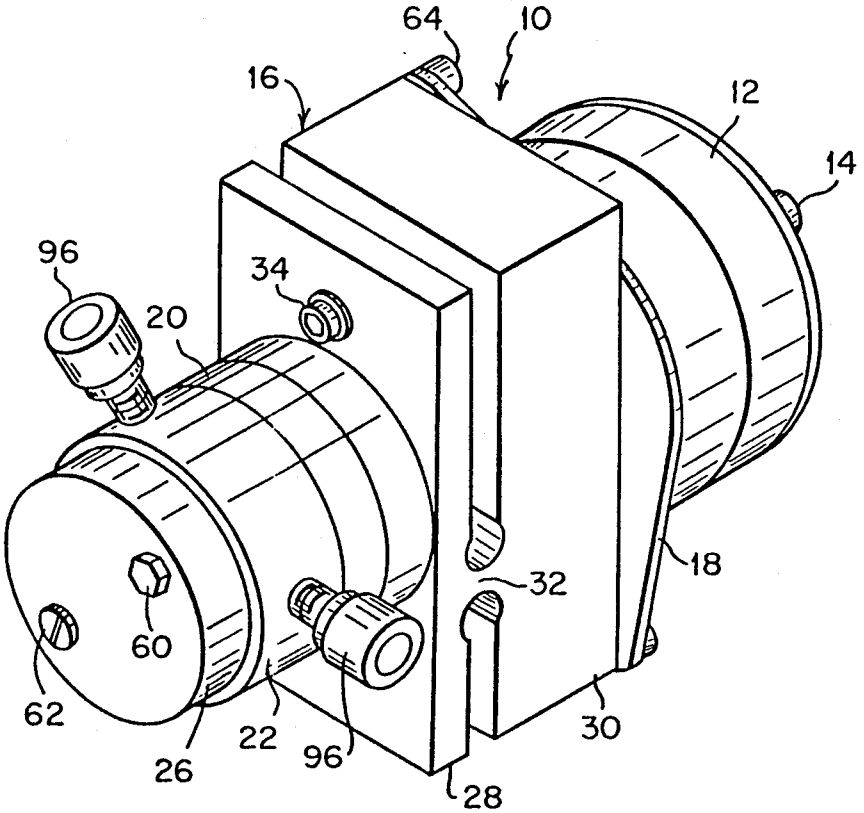
FIG. 1 is a front perspective view of a valveless, positive displacement metering pump according to the invention.
Figure 3:
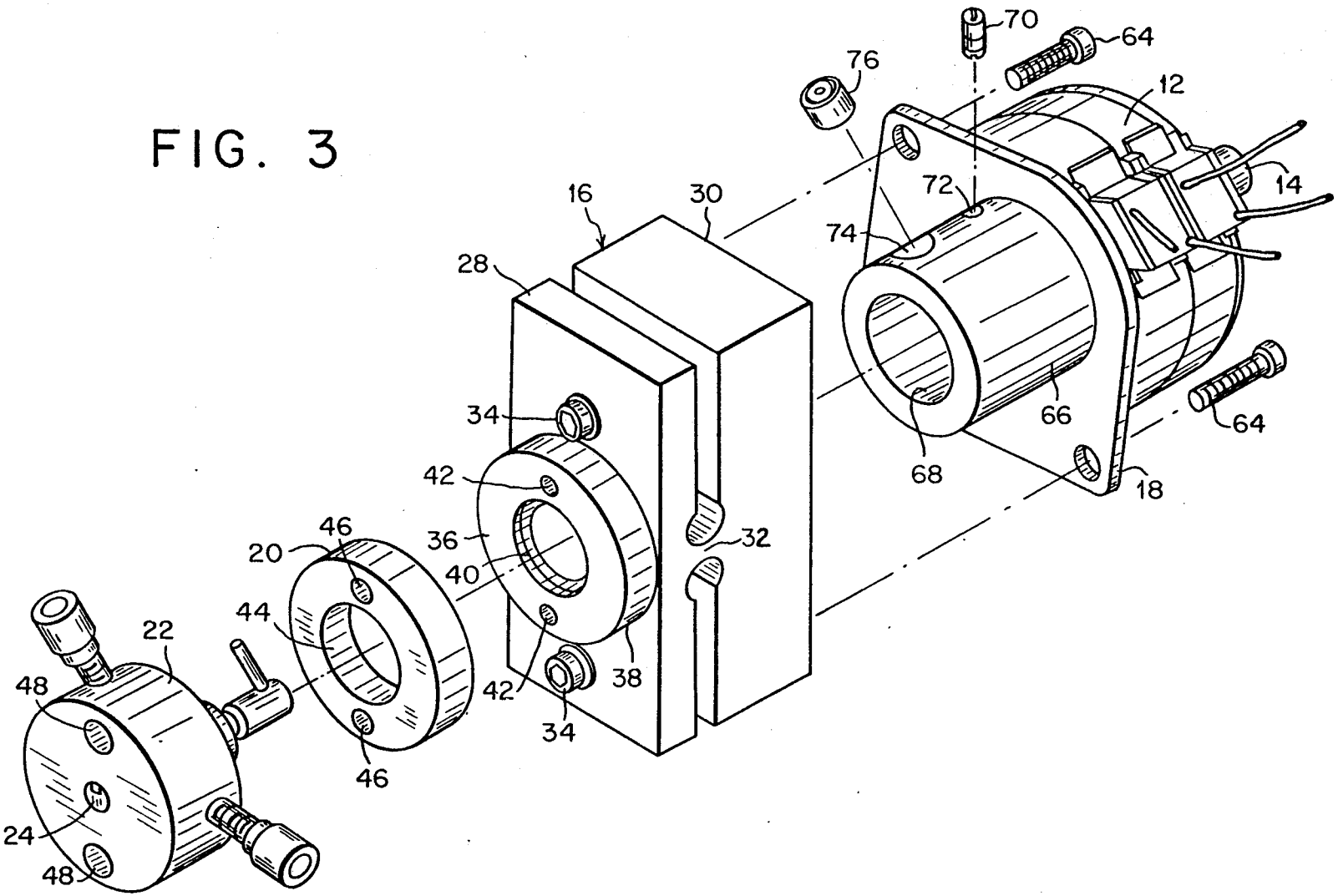
FIG. 3 is an exploded, front perspective view thereof.

Referring to FIGS. 1-3, the pump 10 includes a motor 12 including a drive shaft 14, an integral, hinged block 16, a flat, metal plate 18 secured to the motor housing and the block 16, a cylindrical spacer 20 adjoining the block 16, a cylindrical housing 22 which includes a cylindrical working chamber 24, and a cylindrical closure 26.

The hinged block 16 is made from any suitable ductile material, such as DELRIN, an acetyl copolymer. The block comprises a first support 28 and a second support 30 connected by an integral hinge 32. The second support 30 includes a pair of threaded bores, while the first support 28 includes a pair of unthreaded holes aligned with the threaded bores. First and second screws 34 extend through the respective holes and bores. By turning the screws, the angular orientation of the first support 28 of the block may be changed with respect to the second support 30 as it moves about the integral hinge 32. The screws 34 also serve to maintain the first support 28 in a selected angular position with respect to the second support 30. The hinge 32 otherwise tends to return the first support 28 to a position which is substantially parallel to the front surface of the second support 30.

The block 16 includes a large, cylindrical bore 33 which extends completely through the second support 30 and terminates at a front wall 36 of a cylindrical projection 38 extending from the first support 28. A smaller bore 40 extends through this wall 36. Two small, threaded bores 42 extend at least partially through the projection 38.

The spacer 20 includes an axial bore 44 having about the same diameter as the above-mentioned bore 40, and a pair of unthreaded bores 46 extending therethrough. The axial bore 44 is aligned with the bore 40 through the front wall 36 of the projection 38 while the two smaller bores 46 are aligned, respectively, with the two small, threaded bores 42 within the projection 38.

Figure 4:
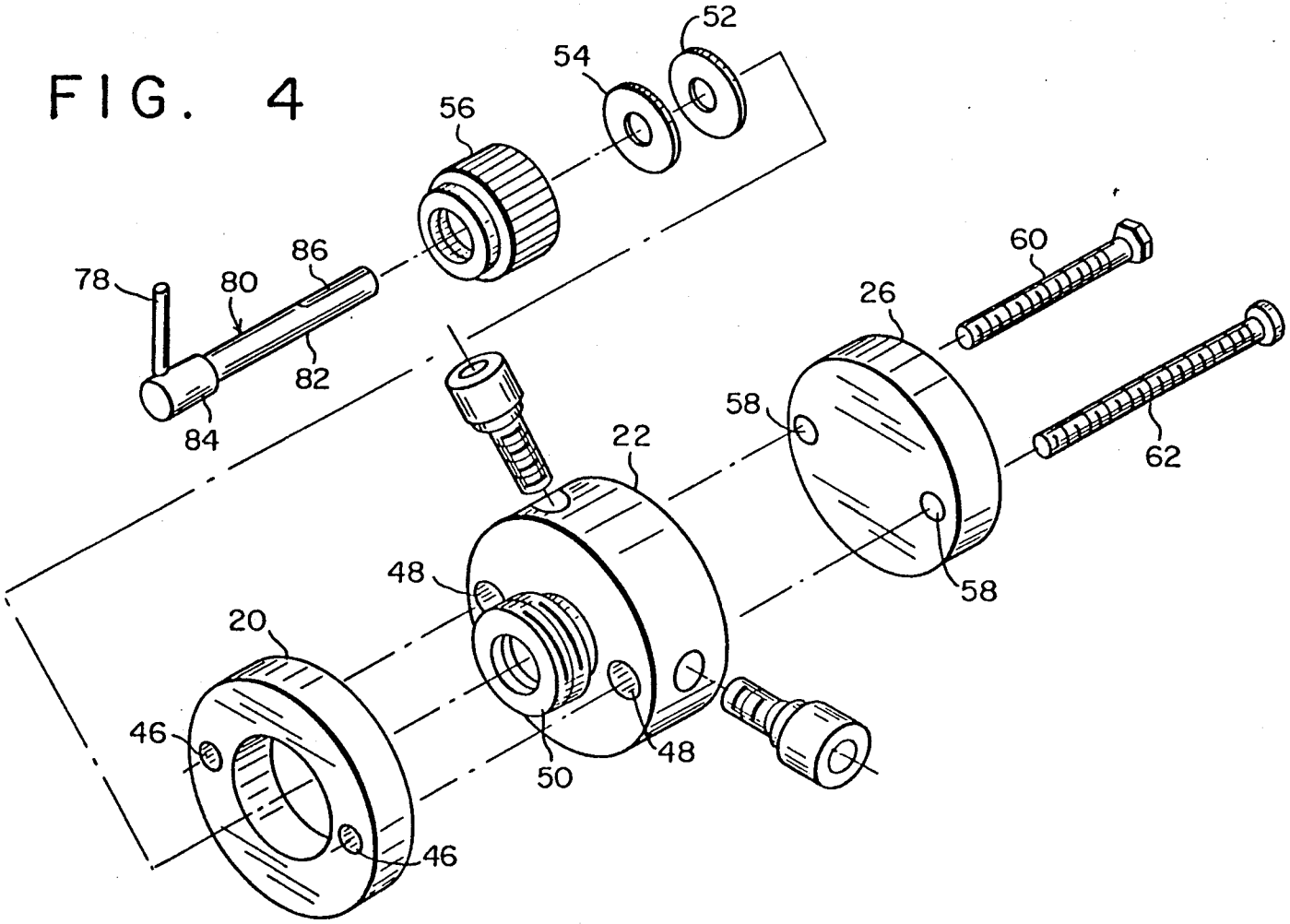
FIG. 4 is an exploded, rear perspective view of several elements of said pump.
Figure 5:
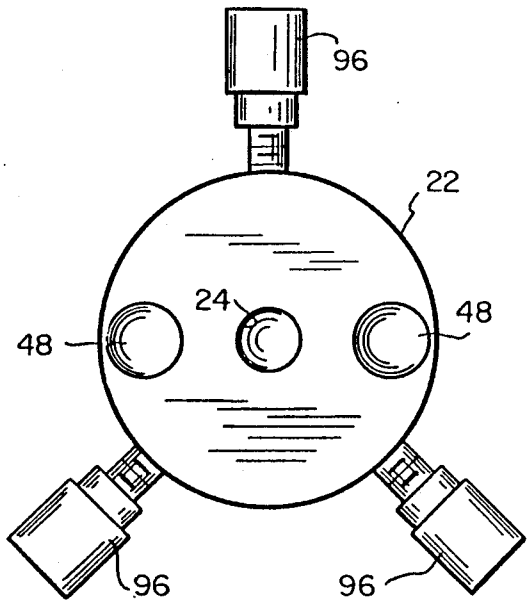
FIG. 5 is a front perspective view of a housing for a pump working chamber.

The housing 22 for the working chamber 24 includes a pair of bores 48 aligned with the bores 46 extending through the spacer. It is preferably made from a ceramic material such as carbon fiber reinforced polyphenylinesulfide, which is sold, for example, under the trade name RYTON. A threaded, cylindrical projection 50, formed integrally with the housing 22, extends rearwardly therefrom. A pair of washers 52,54, as shown in FIG. 4, adjoin the flat, rear face of the projection 50, and are maintained in place by a gland nut 56.

The closure 26 includes a pair of bores 58 extending therethrough. These bores 58 are aligned with the bores 48 extending through the housing 22 of the working chamber 24. The closure includes a flat rear surface which adjoins the flat front surface of the housing 22. It accordingly seals one end of the working chamber 24. As an alternative, the housing and closure could be constructed as one piece, thereby obviating the need for a separate closure. A pair of screws 60,62 extend through the pairs of bores 58,48,46, respectively, and are threadably secured to the block 16 by means of the threaded bores 42. The closure 26, housing 22, spacer 20 and the first support portion 28 of the block 16 are secured, respectively, to each other by this pair of screws 60,62. Each of these elements except the block is shown as having substantially the same outside diameters.

As discussed above, the flat plate 18 is secured to the motor housing. A pair of screws 64 secure the plate 18 to the second support portion 30 of the block 16. As shown in FIG. 3, the front portion of the motor drive shaft 14 is secured to a cylindrical enclosure 66 which functions as a drive cylinder. The cylinder includes a cylindrical chamber 68 having an open front end. The rear end of the chamber is closed by a wall (not shown) through which the front portion of the drive shaft 14 extends. A lock screw 70 extends through a threaded bore 72 which extends through this wall, and bears against the drive shaft 14. The cylinder 66 accordingly rotates with the drive shaft when the motor 12 is actuated.

Figure 9:
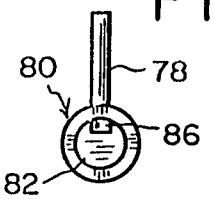
FIG. 9 is a front elevation view thereof.
Figure 8:
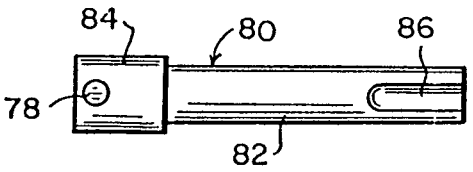
FIG. 8 is a side elevation view of a piston.
Figure 7:
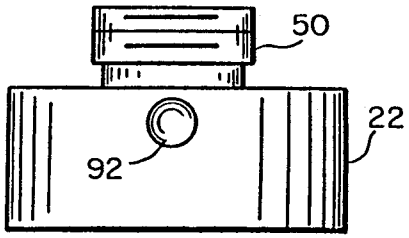
FIG. 7 is a top plan view thereof.

A second, relatively larger bore 74 extends through the drive cylinder 66 and communicates with the chamber 68 therein. A ball and socket fitting 76 is positioned within the bore 74. The ball member of this fitting includes a passage extending therethrough for receiving a connecting rod 78 of a piston assembly 80. The piston assembly, which is best shown in FIGS. 4,8 and 9, includes a cylindrical piston member 82, a cap 84 secured to the rear end of the piston member, the connecting rod 78 extending through the cap and piston member. The front end of the piston member 82 includes a longitudinal duct 86 extending from the end surface thereof to a selected point behind this end surface. The duct is preferably in the form of a channel including a flat bottom wall and a pair of side walls extending perpendicularly therefrom. A v-shaped channel would provide generally equivalent operating results, while a duct in the form of a flat might not allow adequate fluid flow in some instances.

Referring now to FIGS. 4-7, the housing 22 for the working chamber 24 is constructed so that the piston member 82 can rotate and reciprocate freely within the working chamber 24. The front end of the piston member is accordingly chamfered to facilitate such reciprocation. The clearance between the piston member and wall of the working chamber may be about one ten thousandth of an inch. The maximum length of the stroke of the piston member is such that the duct 86 is always entirely within the working chamber 24, and is substantially always in fluid communication with at least one of the three passages 88,90 communicating with the working chamber.

In the embodiment of the invention depicted in the drawings, three passages adjoin the working chamber. The diameters of the passages, axial position of the passages, and the width of the duct 86 are all important in insuring that the proper flow rates into and out of the passages will be obtained.

Figure 6:
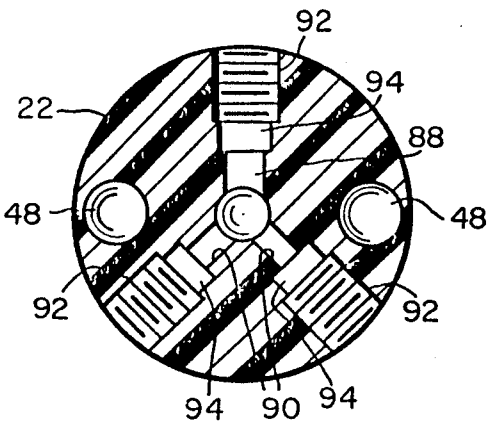
FIG. 6 is a sectional, front elevation view thereof.

As best shown in FIG. 6, one relatively large diameter passage 88 extends along a reference axis which is substantially vertical. Two smaller diameter passages 90 each extend at a forty-five degree angle with respect to the reference axis, and are therefore ninety degrees apart. The diameter of the relatively large passage 88 is twice the diameter of each smaller passage 90. The diameters of the passages would, of course, be adjusted if additional passages were employed.

In a particular embodiment of the invention, discussed here solely for explanatory purposes, a piston member 82 having a quarter inch diameter is employed. The duct 86 within the piston member has a length of about three eighths of an inch. The depth and width of the duct are about 0.093 inches. The channel accordingly traverses an axial distance of about forty-five degrees. The relatively large passage 88 has a diameter of about 0.177 inches while each of the smaller passages 90 in fluid communication with the working chamber 24 have diameters of about 0.089 inches. The axes of the three passages are substantially coplanar so that each will communicate with the duct 86 for a selected length of time as the piston assembly is rotated.

Each passage communicates with a threaded bore 92 which extends between the outer surface of the housing 22 and an angular seating surface 94. A tube (not shown) having a conical fitting (not shown) secured to its end may be inserted with one of the threaded bores until the conical fitting contacts the seating surface 94. The conical fitting is maintained in place by a lock screw 96 which is engaged by the threaded bore. The lock screw presses the conical fitting against the seating surface 94 to provide a fluid-tight seal.

Figure 10:
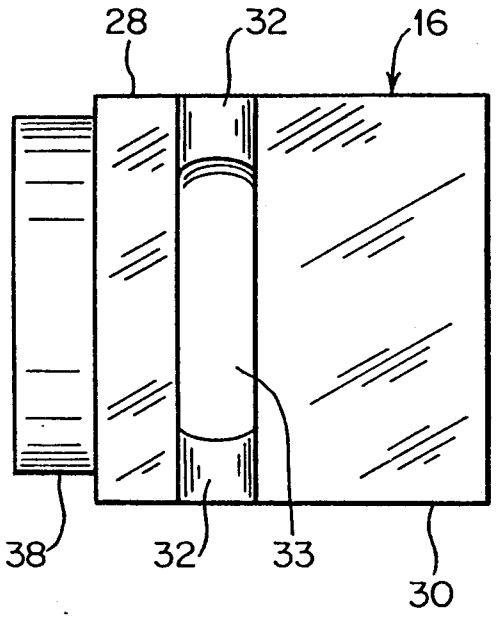
FIG. 10 is a side elevation view of a block for supporting a motor housing and drive cylinder.

Referring to FIG. 10, the hinge 32 connecting the two supports 28,30 defining the block 16 may comprise one or more hinge sections. Multiple sections, such as the two shown in this figure, provide greater flexibility than a continuous hinge extending entirely across the block. The side wall of the drive cylinder 66 may protrude through the space between the two hinge sections. The large cylindrical bore 33, which extends through the block and terminates at the front wall 36 of projection 38, has a diameter which is sufficiently larger than that of the drive cylinder 66 that the first support 28 will not engage it in any angular position with respect to the second support 30. This bore 33 intersects the central portion of the hinge 32, thereby producing the space between the originally continuous, integral, living hinge.

As shown in FIGS. 2 and 10 the hinge 32 includes a pair of arcuate side walls. Such side walls are provided to avoid sharp angles which could cause the block to crack upon the flexing of the hinge.

Figure 11:
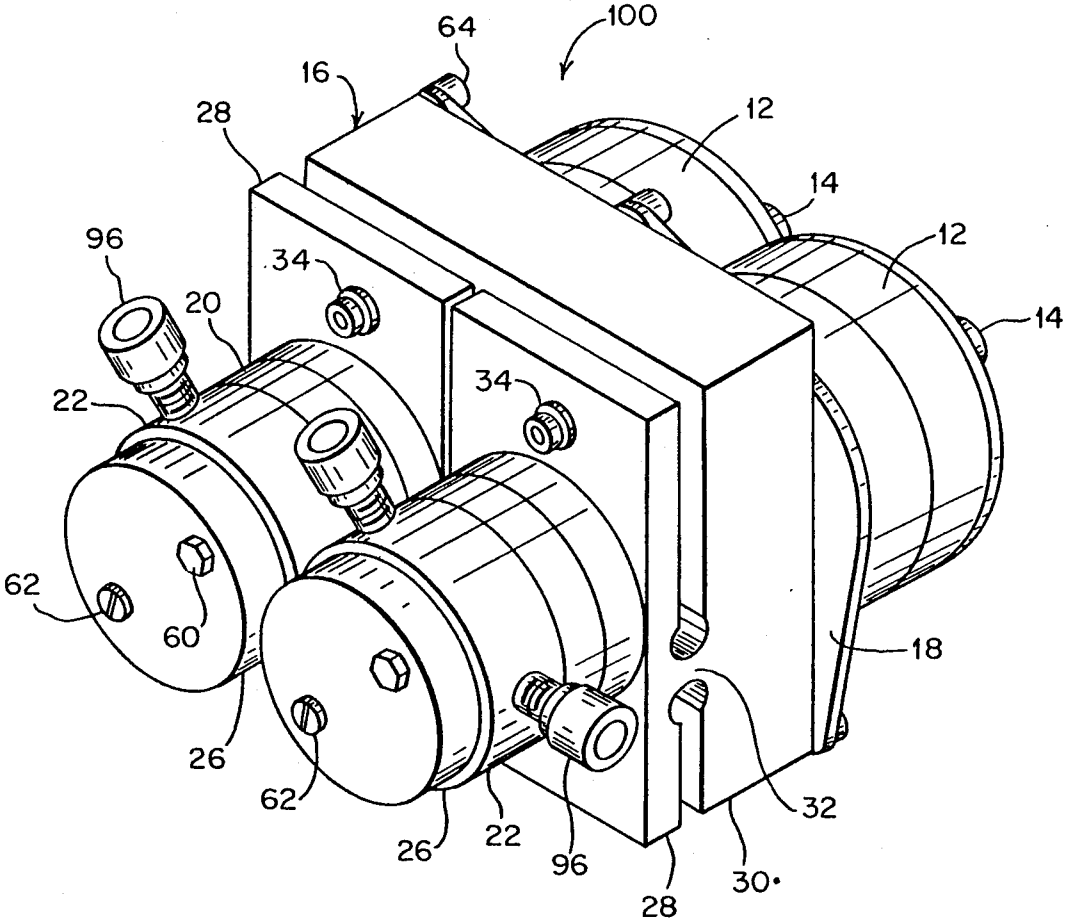
FIG. 11 is a front perspective view of a valveless, positive displacement metering pump including multiple heads.

A second embodiment 100 of the invention is shown in FIG. 11. The same numerals used in FIGS. 1–10 are used in this figure to designate the same or similar parts. The block 16 in this embodiment supports two pumping assemblies. The block includes a pair of first supports 28, a second support 30, and a pair of hinges 32. Each hinge 32 is connected to one of the first supports 28 so that they are pivotable independently from each other. Different flow rates may accordingly be provided by each pumping assembly. The block 16 is of integral construction; and made from the same or similar material as that described above. It is apparent that the block 16 may be constructed so as to accommodate many pumping assemblies, each of them having an independently adjustable flow rate depending upon the angular orientation of the respective first supports 28.

The pumps provided by the invention may be easily manufactured by virtue of the integral construction of the block 16. The block may be extruded as an integral, elongate mass including a base portion, a top portion, and a hinge portion connecting the base portion to the top portion. One or more cuts are made through at least the top and hinge portions. If the mass is not cut completely through, a pump 100 as shown in FIG. 11 may be provided where the top portion of the mass forms the first supports 28 while the base thereof forms the second support 30. The pump 100 shown in FIG. 10 may be cut into two halves by simply cutting through the second support 30, thereby producing two pumps identical to that shown in FIG. 1.

Subsequent to extrusion and optional cutting, one or more relatively large bores are cut within the mass to accommodate the drive cylinders 66. The housings 22 for the working chambers and other components may then be assembled to the block.

In operation, the stroke of the piston assembly is adjusted by turning screws 34 to a position where the front support 28 of the block 16 is at a selected angular orientation with respect to the second support portion 30 thereof. The piston assembly will be caused to reciprocate upon rotation of the motor shaft 14 unless the front and rear support portions of the block 16 are parallel to each other. When in the pumping mode, the rotation of the motor shaft causes rotation of the cylinder 66 secured thereto. The piston assembly 80, being connected to the cylinder 66 by the fitting 76 and connecting rod 78, rotates about its axis at the same time it is caused to reciprocate. The angular orientation of the front portion 28 of the block, and therefore the working chamber 24, with respect to the rear portion 30 of the block, causes the rotation of the fitting 76, and therefore the piston assembly to be eccentric with respect to the working chamber. This causes the combined rotational and reciprocal motion of the piston member 82 within the working chamber 24.

The housing 22 is oriented with respect to the block such that the piston member 82 will be moving in a first axial direction as the duct 86 communicates with the largest of the three passages and in an opposite direction as it moves into communication with the smaller passages 90. For example, if the relatively large passage 88 were to be used as an inflow passage, and the smaller passages were to be used for fluid outflow, the piston assembly would move inwardly as the duct communicates with the larger passage. Suction would be created, and fluid would be drawn into the channel and working chamber. The smaller passages 90 would be sealed by the cylindrical outer surface of the piston member 82 during this phase. As the piston assembly would continues to rotate, it would eventually start moving in the opposite axial direction, i.e. towards the closure 26. The duct would communicate with one of the smaller passages, and then the other, during this pumping phase, thereby moving fluid from the working chamber, through the duct, and into the respective passages. The larger passage 88 would be closed at this time. To reverse the action of the pump, the first support portion 28 of the block 16 would simply have to be pivoted about the hinge 32 to an opposite angular orientation.

In order to avoid undue strain upon the pump, the length and width of the duct 86, and the diameters and positions of the three passages 88,90 are constructed such that the duct is substantially always in fluid communication with one of the three passages regardless of the axial or rotational position of the piston assembly 80. The stroke of the piston assembly should be less than the length of the duct.

While the pump shown in the figures includes only three passages which communicate with the duct and working chamber, it will be appreciated that fewer or more passages may be provided at different radial positions to provide different inflow or outflow capabilities. The diameters of the respective passages may also be modified if unequal flows are desired.

In accordance with the pump as illustrated, the relatively large passage 88 is in fluid communication with the duct over about one hundred eighty degrees of rotation of the piston assembly 80. The second and third passages, which have the same diameter, each communicate with the duct over about ninety degrees of rotation apiece. The piston member 82 moves in one axial direction as the duct communicates with the first passage 88. It moves in the opposite axial direction when communicating with the other two passages 90. Both the passages and the duct form relatively sharp corners with respect to the working chamber to insure the precise control of fluid flow within the pump.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A valveless, positive displacement metering pump comprising:

a housing including a substantially cylindrical working chamber therein and at least two ports communicating with said working chamber;

a first support;

means for mounting said housing to said first support;

a second support;

flexible hinge means connecting said first and second supports such that said first support is pivotable with respect to said second support about said hinge means, said first and second supports and said hinge means being of integral construction, a piston positioned within said working chamber, said piston including a duct therein;

a rotatable member;

means for rotatably securing said rotatable member to said second support;

means for rotating said rotatable member; and means for connecting said piston to said rotatable member such that said piston rotates and reciprocates within said working chamber upon rotation of said rotatable member, the stroke of said piston being dependent upon the angular position of said first support with respect to said second support.

2. A pump as defined in claim 1 wherein said flexible hinge means include a pair of hinge elements connecting said first support to said second support.

3. A pump as defined in claim 1 wherein said rotatable member includes a cylindrical wall, said means for connecting said piston to said rotatable member including a rod pivotably connected to said cylindrical wall.

4. A pump as defined in claim 3 wherein said second support includes an opening, said rotatable member being positioned within said opening.

5. A pump as defined in claim 4 wherein said means for rotating said rotatable member include a motor and a drive shaft extending from said motor, said rotatable member being connected to said drive shaft.

6. A pump as defined in claim 5 wherein said motor is mounted to said second support.

7. A pump as defined in claim 5 including means for moving said first support with respect to said second support about a pivot axis defined by said hinge means.

8. A pump as defined in claim 7 including means for maintaining said first support in a selected angular position with respect to said second support.

9. A pump as defined in claim 1 including means for moving said first support with respect to said second support about a pivot axis defined by said hinge means.

10. A pump as defined in claim 9 including means for maintaining said first support in a selected angular position with respect to said second support.

11. A pump as defined in claim 1 wherein said flexible hinge means include first and second side walls, each of said side walls being substantially arcuate.

12. A pump as defined in claim 1 including:

a second housing including a substantially cylindrical working chamber therein and at least two ports communicating with said working chamber;

a third support;

means for mounting said second housing to said third support;

second flexible hinge means connecting said third and second supports such that said third support is pivotable with respect to said second support about said second flexible hinge means, said first, second and third supports and said second flexible hinge means being of integral construction;

a second piston positioned within said working chamber within said second housing, said second piston including a duct therein;

a second rotatable member;

means for securing said second rotatable member to said second support;

means for rotating said second rotatable member; and means for connecting said second piston to said second rotatable member such that said second piston rotates and reciprocates within said working chamber within said second housing upon rotation of said second rotatable member, the stroke of said second piston being dependent upon the angular position of said third support with respect to said second support.

13. A pump as defined in claim 12 including means for moving said first and third supports with respect to said second support about pivot axes defined by said respective flexible hinge means.

14. A pump as defined in claim 13 including means for maintaining said first and third supports in selective angular positions with respect to said second support.

15. A pump as defined in claim 14 wherein each of said rotatable members includes a cylindrical wall, said means for connecting said respective pistons to said respective rotatable members including two connecting rods pivotably connected, respectively, to said respective cylindrical walls.

16. A pump as defined in claim 15 wherein said second support includes first and second openings, said rotatable members being positioned, respectively, within said first and second openings.

17. A pump as defined in claim 15 wherein each of said flexible hinge means includes first and second side walls, each of said side walls being substantially arcuate.

* * * * *